US010883317B2

(12) United States Patent
Bird et al.

(10) Patent No.: US 10,883,317 B2
(45) Date of Patent: Jan. 5, 2021

(54) POLYCRYSTALLINE DIAMOND COMPACTS AND EARTH-BORING TOOLS INCLUDING SUCH COMPACTS

(71) Applicants: Diamond Innovations, Inc., Worthington, OH (US); Baker Hughes Incorporated, Houston, TX (US)

(72) Inventors: Marc W. Bird, Houston, TX (US); Andrew Gledhill, Westerville, OH (US)

(73) Assignees: Baker Hughes Incorporated, Houston, TX (US); Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 16/292,982

(22) Filed: Mar. 5, 2019

(65) Prior Publication Data

US 2019/0203541 A1 Jul. 4, 2019

Related U.S. Application Data

(62) Division of application No. 15/060,911, filed on Mar. 4, 2016, now Pat. No. 10,287,824.

(51) Int. Cl.
*E21B 10/56* (2006.01)
*B24D 18/00* (2006.01)
(Continued)

(52) U.S. Cl.
CPC ..... *E21B 10/56* (2013.01); *B24D 18/0009* (2013.01); *C22C 26/00* (2013.01);
(Continued)

(58) Field of Classification Search
CPC ..... E21B 10/50; E21B 10/54; B24D 18/0009
See application file for complete search history.

(56) References Cited

U.S. PATENT DOCUMENTS 3,141,746 A 7/1964 De Lai
3,609,818 A 10/1971 Wentorf
(Continued)

FOREIGN PATENT DOCUMENTS

CN 101168229 A 4/2008
CN 101611210 A 12/2009
(Continued)

OTHER PUBLICATIONS

International Search Report for International Application No. PCT/US2017/020414 dated Jun. 2, 2017, 4 pages.‡
(Continued)

*Primary Examiner* — Pegah Parvini
(74) *Attorney, Agent, or Firm* — TraskBritt

(57) ABSTRACT

A polycrystalline diamond compact includes a polycrystalline diamond material having a plurality of grains of diamond bonded to one another by inter-granular bonds and an intermetallic gamma prime (γ') or κ-carbide phase disposed within interstitial spaces between the inter-bonded diamond grains. The ordered intermetallic gamma prime (γ') or κ-carbide phase includes a Group VIII metal, aluminum, and a stabilizer. An earth-boring tool includes a bit body and a polycrystalline diamond compact secured to the bit body. A method of forming polycrystalline diamond includes subjecting diamond particles in the presence of a metal material comprising a Group VIII metal and aluminum to a pressure of at least 4.5 GPa and a temperature of at least 1,000° C. to form inter-granular bonds between adjacent diamond particles, cooling the diamond particles and the metal material to a temperature below 500° C., and forming an intermetallic gamma prime (γ') or κ-carbide phase adjacent the diamond particles.

20 Claims, 6 Drawing Sheets

(51) Int. Cl.

| | |
|---|---|
| ***E21B 10/54*** | (2006.01) |
| ***E21B 10/50*** | (2006.01) |
| ***C22C 29/00*** | (2006.01) |
| ***C22C 26/00*** | (2006.01) |
| *B22F 5/00* | (2006.01) |

(52) U.S. Cl.

CPC ..... *C22C 29/005* (2013.01); *B22F 2005/001* (2013.01); *C22C 2026/006* (2013.01); *C22C 2026/008* (2013.01); *E21B 10/50* (2013.01); *E21B 10/54* (2013.01)

(56) References Cited

U.S. PATENT DOCUMENTS 3,745,623 A 7/1973 Wentorf et al.
3,850,591 A 11/1974 Wentorf
4,394,170 A 7/1983 Sawaoka et al.
4,403,015 A 9/1983 Nakai et al.
4,505,746 A ‡ 3/1985 Nakai ..... B01J 3/062 419/11
4,525,178 A ‡ 6/1985 Hall ..... B01J 3/062 51/293
4,636,253 A ‡ 1/1987 Nakai ..... B01J 3/062 419/11
4,694,918 A 9/1987 Hall
4,794,326 A 12/1988 Friedl
4,907,377 A ‡ 3/1990 Csillag ..... B01J 3/062 51/307
4,911,989 A ‡ 3/1990 Minoru ..... C22C 1/051 419/13
4,954,139 A 9/1990 Cerutti
4,975,125 A ‡ 12/1990 Chakrabarti ..... C22C 14/00 148/40
5,106,674 A ‡ 4/1992 Okada ..... C22C 29/02 407/11
5,111,895 A ‡ 5/1992 Griffin ..... C04B 37/021 175/37
5,127,923 A 7/1992 Bunting et al.
5,128,080 A ‡ 7/1992 Jurewicz ..... C22C 26/00 264/66
5,266,236 A ‡ 11/1993 Bovenkerk ..... B01J 3/062 252/50
5,304,342 A ‡ 4/1994 Hall, Jr. ..... B01J 3/062 419/11
5,310,605 A 5/1994 Baldoni et al.
5,468,268 A 11/1995 Tank et al.
5,505,748 A 4/1996 Tank et al.
5,580,666 A ‡ 12/1996 Dubensky ..... C22C 29/08 428/54
5,649,279 A 7/1997 Gustafson et al.
5,880,382 A ‡ 3/1999 Fang ..... C22C 1/051 175/37
5,955,186 A 9/1999 Grab
5,992,546 A ‡ 11/1999 Heinrich ..... C22C 29/067 175/37
6,024,776 A ‡ 2/2000 Heinrich ..... C22C 19/07 75/238
6,217,992 B1 4/2001 Grab
6,248,447 B1 6/2001 Griffin et al.
6,261,329 B1 ‡ 7/2001 Ogata ..... C04B 35/52 419/11
6,294,129 B1 ‡ 9/2001 Waldenstrom ..... C22C 1/051 419/18
6,432,150 B1 ‡ 8/2002 Levashov ..... B22F 3/23 164/97
6,517,902 B2 2/2003 Drake et al.
6,541,115 B2 ‡ 4/2003 Pender ..... C04B 41/009 407/11
6,846,341 B2 ‡ 1/2005 Middlemiss ..... B22F 7/06 51/293
7,074,247 B2 7/2006 Tank et al.
7,462,003 B2 ‡ 12/2008 Middlemiss ..... B22F 7/06 407/11
7,475,948 B2 1/2009 Hall et al.
7,487,849 B2 ‡ 2/2009 Radtke ..... E21B 10/5735 175/43
7,556,668 B2 ‡ 7/2009 Eason ..... B22F 3/15 175/42
7,569,179 B2 8/2009 Fang
7,635,035 B1 ‡ 12/2009 Bertagnolli ..... B32B 9/00 175/43
7,678,325 B2 ‡ 3/2010 Gardinier ..... A61F 2/30767 264/60
7,691,173 B2 ‡ 4/2010 Eason ..... B22F 3/15 175/42
7,699,904 B2 4/2010 Fang
7,757,791 B2 ‡ 7/2010 Belnap ..... B22F 7/06 175/37
7,879,129 B2 ‡ 2/2011 Kosters ..... C22C 26/00 175/42
8,080,071 B1 12/2011 Vail
8,147,574 B2 ‡ 4/2012 Montross ..... B01J 3/062 51/307
8,162,082 B1 ‡ 4/2012 Gonzalez ..... E21B 10/567 175/42
8,490,721 B2 ‡ 7/2013 Naidoo ..... B24D 99/005 175/42
8,496,076 B2 ‡ 7/2013 DiGiovanni et al. ... C04B 35/52 175/43
8,512,874 B2 ‡ 8/2013 Darolia ..... C23C 4/18 416/24
8,522,900 B2 ‡ 9/2013 Bellin ..... E21B 10/5735 175/43
8,579,052 B2 ‡ 11/2013 DiGiovanni et al. ..... B24D 99/005 175/40
8,651,203 B2 ‡ 2/2014 DiGiovanni ..... B22F 3/14 175/42
8,727,042 B2 ‡ 5/2014 DiGiovanni ..... B24D 99/005 175/42
8,764,919 B2 ‡ 7/2014 Nazmy ..... C22C 19/07 148/42
8,936,116 B2 ‡ 1/2015 Lyons ..... E21B 10/5735 175/42
9,027,675 B1 ‡ 5/2015 Jones ..... E21B 10/46 175/42
9,085,489 B2 ‡ 7/2015 Naidoo ..... C04B 37/026
9,103,172 B1 ‡ 8/2015 Bertagnolli ..... B32B 9/00
9,255,316 B2 ‡ 2/2016 Bryan ..... C22C 14/00
9,272,392 B2 ‡ 3/2016 Mukhopadhyay ..... B01J 3/062
9,487,847 B2 ‡ 11/2016 Mukhopadhyay ..... B22F 7/062
9,540,885 B2 ‡ 1/2017 Mukhopadhyay ..... B22F 3/14
9,610,555 B2 ‡ 4/2017 Mukhopadhyay ..... B01J 3/065
9,649,748 B2 ‡ 5/2017 Konovalov ..... B24D 3/06
9,657,529 B1 ‡ 5/2017 Bertagnolli ..... E21B 10/567
9,718,168 B2 ‡ 8/2017 Mukhopadhyay ..... B24D 3/10
9,719,307 B1 ‡ 8/2017 Bertagnolli ..... B32B 9/00
9,765,572 B2 ‡ 9/2017 Knuteson ..... E21B 10/567
2002/0020564 A1 ‡ 2/2002 Fang ..... B22F 1/0003 175/37
2002/0112896 A1 ‡ 8/2002 Kruse ..... C22C 29/08 175/42
2002/0194955 A1 ‡ 12/2002 Fang ..... C09K 3/1418 75/240
2003/0113560 A1 * 6/2003 Yong ..... E21B 10/56 428/469
2003/0129456 A1 ‡ 7/2003 Usami ..... B24D 3/06 428/69
2004/0159471 A1 ‡ 8/2004 Azar ..... B22F 7/06 175/43
2004/0187638 A1 ‡ 9/2004 Heinrich ..... C22C 1/053 75/240
2005/0050801 A1 ‡ 3/2005 Cho ..... B22F 7/008 51/293
2005/0115744 A1 6/2005 Griffin et al.
2005/0133277 A1 ‡ 6/2005 Dixon ..... B23C 5/1009 175/42
2005/0230156 A1 ‡ 10/2005 Belnap ..... B22F 7/06 175/37

(56) References Cited

U.S. PATENT DOCUMENTS

2005/0262965 A1‡ 12/2005 Palanisamy ..... C22C 29/06 75/236
2006/0162969 A1‡ 7/2006 Belnap ..... B22F 7/06 175/43
2006/0166615 A1 7/2006 Tank et al.
2006/0263233 A1‡ 11/2006 Gardinier ..... A61F 2/30767 419/11
2007/0023206 A1‡ 2/2007 Keshavan ..... E21B 10/16 175/37
2007/0056778 A1 3/2007 Webb et al.
2007/0099030 A1 5/2007 Dahl
2007/0102200 A1‡ 5/2007 Choe ..... E21B 10/00 175/37
2007/0186483 A1 8/2007 Tank et al.
2007/0187153 A1 8/2007 Bertagnolli
2007/0187155 A1 8/2007 Middlemiss
2007/0292671 A1‡ 12/2007 Akesson ..... C22C 29/08 428/21
2007/0292672 A1‡ 12/2007 Ljungberg ..... C22C 29/08 428/21
2008/0017421 A1‡ 1/2008 Lockwood ..... B24D 3/06 175/43
2008/0073126 A1‡ 3/2008 Shen ..... E21B 10/567 175/43
2008/0073127 A1‡ 3/2008 Zhan ..... B24D 3/02 175/43
2008/0075543 A1‡ 3/2008 Zhu ..... B23B 27/14 407/11
2008/0115421 A1 5/2008 Sani
2008/0128176 A1‡ 6/2008 Choe ..... B22D 23/00 175/42
2008/0142276 A1 6/2008 Griffo et al.
2008/0185078 A1‡ 8/2008 Ishida ..... C22C 19/07 148/67
2008/0185189 A1 8/2008 Griffo et al.
2008/0223621 A1 9/2008 Middlemiss et al.
2008/0223623 A1 9/2008 Keshavan et al.
2008/0230280 A1 9/2008 Keshavan et al.
2008/0295658 A1‡ 12/2008 Donnadieu ..... C04B 35/581 83/13
2008/0302579 A1‡ 12/2008 Keshavan ..... B22F 7/08 175/43
2009/0017332 A1‡ 1/2009 Kisi ..... C04B 35/4508 428/69
2009/0022952 A1 1/2009 Keshavan
2009/0032169 A1‡ 2/2009 Dourfaye ..... C22C 1/1068 156/90
2009/0071727 A1‡ 3/2009 Keshavan ..... C04B 35/52 175/43
2009/0090563 A1 4/2009 Voronin et al.
2009/0114454 A1‡ 5/2009 Belnap ..... B22F 7/06 175/43
2009/0152018 A1‡ 6/2009 Sani ..... B21C 3/02 175/43
2009/0173015 A1 7/2009 Keshavan et al.
2009/0173547 A1 7/2009 Voronin et al.
2009/0178855 A1 7/2009 Zhang
2009/0183925 A1 7/2009 Zhang et al.
2009/0260895 A1‡ 10/2009 Vail ..... B01J 3/062 175/434
2009/0324873 A1 12/2009 Weis et al.
2010/0012389 A1 1/2010 Zhang et al.
2010/0038148 A1* 2/2010 King ..... C04B 35/515 175/430
2010/0050536 A1‡ 3/2010 Montross ..... B01J 3/062 51/309
2010/0084196 A1 4/2010 Bertagnolli et al.
2010/0084197 A1‡ 4/2010 Voronin ..... B22F 7/062 175/42
2010/0104874 A1 4/2010 Yong et al.
2010/0122852 A1‡ 5/2010 Russell ..... C22C 26/00 175/42
2010/0126779 A1 5/2010 Corbett et al.
2010/0199573 A1‡ 8/2010 Montross ..... C22C 26/00 51/307
2010/0275523 A1 11/2010 Tank
2010/0285335 A1‡ 11/2010 Sithebe ..... C22C 26/00 428/69
2011/0067929 A1‡ 3/2011 Mukhopadhyay ..... B01J 3/062 175/43
2011/0114394 A1‡ 5/2011 Lockwood ..... B22D 19/14 175/42
2011/0116963 A1‡ 5/2011 Fang ..... B22F 3/1017 419/18
2011/0171484 A1‡ 7/2011 Konyashin ..... C23C 26/02 428/55
2012/0005966 A1‡ 1/2012 Cleboski ..... E21B 10/46 51/295
2012/0012402 A1‡ 1/2012 Thigpen ..... C22C 26/00 175/43
2012/0031675 A1‡ 2/2012 Truemner ..... B01J 3/062 175/57
2012/0034464 A1* 2/2012 Chakraborty ..... B82Y 30/00 428/402
2012/0040183 A1‡ 2/2012 Kelkar ..... B22F 3/1035 428/36
2012/0055716 A1‡ 3/2012 Martensson ..... C22C 26/00 175/42
2012/0151848 A1‡ 6/2012 Suryavanshi ..... B22F 5/00 51/309
2012/0324801 A1‡ 12/2012 Fang ..... B01J 3/062 51/309
2012/0325565 A1‡ 12/2012 Fang ..... B22F 3/1035 175/43
2013/0092449 A1‡ 4/2013 Fang ..... B22F 3/156 175/37
2013/0092452 A1‡ 4/2013 Mukhopadhyay ..... B22F 7/062 175/42
2013/0133957 A1 5/2013 Belnap et al.
2013/0206287 A1‡ 8/2013 Sato ..... C22C 19/055 148/42
2014/0023546 A1‡ 1/2014 Konyashin ..... B22F 3/24 419/18
2014/0086782 A1‡ 3/2014 Gries ..... C22C 29/00 419/12
2014/0134403 A1 5/2014 Gledhill
2014/0174633 A1‡ 6/2014 Andersin ..... C04B 35/52 156/89
2014/0231151 A1* 8/2014 Matthias ..... B24D 18/0009 175/432
2014/0311810 A1‡ 10/2014 Konyashin ..... C22C 26/00 175/43
2014/0353047 A1* 12/2014 Naidoo ..... C04B 35/52 175/432
2015/0136495 A1 5/2015 Knuteson et al.
2015/0284827 A1‡ 10/2015 Can ..... E21B 10/567 51/309
2015/0376744 A1‡ 12/2015 Konyashin ..... C22C 26/00 51/309
2016/0052108 A1 2/2016 Miess
2016/0053549 A1 2/2016 DiGiovanni et al.
2016/0063549 A1‡ 2/2016 Fuchs ..... G06Q 30/0255 705/14
2016/0265285 A1 9/2016 Stockey et al.
2017/0266784 A1‡ 9/2017 Zhang ..... C04B 35/528
2017/0267588 A1 9/2017 Shin et al.
2018/0327888 A1 11/2018 Cao et al.
2018/0328117 A1 11/2018 Bird
2019/0368278 A1 12/2019 Cao et al.

FOREIGN PATENT DOCUMENTS

CN 101755066 A 6/2010
CN 103722174 A 4/2014
CN 104057094 A 9/2014
EP 0278703 A2 8/1988
EP 0476352 A1 ‡ 3/1992 ..... B01J 3/062
EP 0476352 A1 3/1992
EP 0974566 A1 1/2000

(56) References Cited

FOREIGN PATENT DOCUMENTS

| | | | | | |
|---|---|---|---|---|---|
| EP | 3369831 | A1 | | 9/2018 | |
| GB | 2489583 | A | | 10/2012 | |
| JP | 01-116048 | A | | 5/1989 | |
| JP | 1116048 | A | ‡ | 5/1989 | |
| JP | 03-054166 | A | | 3/1991 | |
| JP | 2014-208889 | A | | 11/2014 | |
| WO | 2004/054943 | A1 | | 7/2004 | |
| WO | 2006/001791 | A1 | | 1/2006 | |
| WO | WO-2006001791 | | ‡ | 1/2006 | |
| WO | 2006/032984 | A2 | | 3/2006 | |
| WO | 2007/035394 | A2 | | 3/2007 | |
| WO | 2007/110770 | A2 | | 10/2007 | |
| WO | 20081086284 | A2 | | 7/2008 | |
| WO | 2009/027948 | A1 | | 3/2009 | |
| WO | 2009/027949 | A1 | | 3/2009 | |
| WO | 20091147629 | A1 | | 12/2009 | |
| WO | 20101029518 | A1 | | 3/2010 | |
| WO | 2013/087728 | A2 | | 6/2013 | |
| WO | 2013/092370 | A1 | | 6/2013 | |
| WO | 20131087773 | A1 | | 6/2013 | |
| WO | WO-2013087728 | | ‡ | 6/2013 | |
| WO | WO-2013092370 | A1 | ‡ | 6/2013 | ..... C04B 37/023 |
| WO | 2013/178550 | A1 | | 12/2013 | |
| WO | 2013/178552 | A1 | | 12/2013 | |
| WO | WO-2013178550 | | ‡ | 12/2013 | |
| WO | WO-2013178552 | | ‡ | 12/2013 | |
| WO | 2016/049452 | A1 | | 3/2016 | |
| WO | WO-2016/049452 | A1 | ‡ | 3/2016 | ..... B22F 3/14 |

OTHER PUBLICATIONS

International Written Opinion for International Application No. PCT/US2017/020414 dated Jun. 2, 2017, 7 pages.‡

Kimura et al., Phase Stability and Relations of Multi-phase Alloys Based on B2 CoAl and E21 Co2AlC, Intermetallics, vol. 3, Issue 5, 1995, pp. 413-425. (Abstract only).‡

Kimura et al., Phase Equilibria in the T-Al-C (T: Co, Ni, Rh, Ir) and T-Al-B (T: Rh, Ir) Systems for the Design of E21-Co3AlC Based Heat Resistant Alloys, Intermetallics, vol. 14, Issue 5, May 2006, pp. 508-514. (Abstract only).‡

Andreeve et al., Features of the Influence of Nanomodivication and Macrostructureization on the Properties of the Fe—Mo Binder for a Didamond Tool, Russian Journal of Non Ferrous Metals, vol. 55, No. 6, (Nov. 2014), pp. 82-86.‡

Correa et al., Microstructure and Mecanical Properties of Wc Ni—Si Based Cemented Carbides Developed by Powder Metallurgy, International Journal of Refractory Metals and Hard Materials, vol. 28, Issue 5, (Sep. 2010), pp. 572-575.‡

Kruth et al., Lasers and Materials in Selective Laser Sintering, Assembly Automation, vol. 23, Issue 4, (2003), pp. 357-371.‡

Levashov et al., Improved Mechanical and Tribological Properties of Metal-Matrix Composites Dispersion-Strengthened by Nanoparticles, Materials, vol. 3, (2010), pp. 97-109.‡

Sidorenko et al., Interaction of Diamond Grains with Nanosized Alloying Agents in Metal-Matrix Composites a Studied by Raman Spectroscopy, Diamond & Related Materials, vol. 38,, (Sep. 2013), pp. 59-62.‡

Zaitzev et al., Diamond Tools in Metal Bonds Dispersion Strengthened with Nanosized Particles for Cutting Highly Reinforced Concrete, Journal of Superhard Materials, vol. 32, No. 6, (Dec. 2010), pp. 423-431.‡

Underwood, Ervin E., Quantitative Stereology, Addison Wesley Publishing Company, Inc., (1970), pp. 80-109.

Kimura et al., Phase Equilibria in the T-A1-C (T: Co, Ni, Rh, Ir) and T-Al-B (T: Rh, Ir) Systems for the Design of E21-Co3AlC Based Heat Resistant Alloys, Intermetallics, vol. 14, Issue 5, May 2006, pp. 508-514. (Abstract only).

Canadian Office Action and Examination Search Report for Canadian Application No. 3,016,597, dated Jun. 19, 2019, 4 pages.

International Preliminary Report on Patentability for International Application No. PCT/US2017/020414, dated Sep. 4, 2018, 8 pages.

Kimura et al., Phase Equilibria in the T—Al—C (T: Co, Ni, Rh, Ir) and T—Al—B (T: Rh, Ir) Systems for the Design of E21-Co3AIC Based Heat Resistant Alloys, Intermetallics, vol. 14, Issue 5, May 2006, pp. 508-514.

Kimura et al., Phase Stability and Relations of Multi-phase Alloys Based on B2 CoAl and E21 Co3AIC, Intermetallics, vol. 3, Issue 5, 1995, pp. 413-425.

Akaishi et al., "Thermal Properties of Sintered Diamond with Small Amounts of Metal," Science and Technology of New Diamond, (1990) pp. 129-134.

Akaishi et al., Material Science and Engineering A (1988), vol. 05/106, 1 and 2 (Abstract only).

German, R.M., "The Contiguity of Liquid Phase Sintered Microstructures," Metallurgical Transactions A, vol. 16A, Jul. 1985, pp. 1247-1252.

Gupta, K.P.; "The Co—Cr—W (cobalt-Chromium-Tungsten) System", Journal of Phase Equilibria and Diffusion, vol. 24, No. 2, Apr. 1, 2006, pp. 178-183.

Metals Handbook, 8th Ed, vol. 2, American Society for Metals, 1964, pp. 93-114.

European Search Report and Opinion for European Application No. 17760799 dated Sep. 26, 2019, 9 pages.

Chinese First Office Action for Chinese Application No. 201780024446, dated Oct. 31, 2019, 17 pages with English Translation.

European Communication pursuant to Article 94(3) EPC for European Application No. 17760799, dated Jul. 2, 2020, 8 pages.

Freund et al., Formation of Cuboidal Co3AIC Precipitates in Carbon-Containing Co-Al-W-Based Superalloys, Advanced Engineering Materials 2015, 17, No. 8, pp. 1113-1118.

Ohtani et al., Thermodynamic analysis of the Co—Al—C and Ni—Al—C systems by incorporating ab initio energetic calculations into the Calphad approach, Computer Coupling of Phase Diagrams and Thermochemistry 28 (2004) pp. 177-190.

Russian Office Action for Russian Application No. 2018133336, dated May 13, 2020, 3 pages.

* cited by examiner
‡ imported from a related application

POLYCRYSTALLINE DIAMOND COMPACTS AND EARTH-BORING TOOLS INCLUDING SUCH COMPACTS

CROSS-REFERENCE TO RELATED APPLICATIONS

This application is a divisional of U.S. patent application Ser. No. 15/060,911, filed Mar. 4, 2016, now U.S. Pat. No. 10,287,824, issued May 14, 2019, the disclosure of which is hereby incorporated herein in its entirety by this reference. The subject matter of this application is related to the subject matter of U.S. patent application Ser. No. 15/594,174, filed May 12, 2017, for "Methods of Forming Supporting Substrates for Cutting Elements, and Related Cutting Elements, Methods of Forming Cutting Elements, and Earth-Boring Tools," to U.S. patent application Ser. No. 16/581,152, filed Sep. 24, 2019, for "Methods of Forming Supporting Substrates for Cutting Elements, and Related Methods of Forming Cutting Elements," which application is divisional of U.S. patent application Ser. No. 15/594,174, to U.S. patent application Ser. No. 15/842,530, filed Dec. 14, 2017, for "Methods of Forming Supporting Substrates for Cutting Elements, and Related Cutting Elements, Methods of Forming Cutting Elements, and Earth-Boring Tools," and to U.S. patent application Ser. No. 15/993,362, filed May 30, 2018, for "Cutting Elements, and Related Earth-Boring Tools, Supporting Substrates, and Methods."

TECHNICAL FIELD

Embodiments of the present disclosure relate generally to polycrystalline hard materials, cutting elements comprising such hard materials, earth-boring tools incorporating such cutting elements, and method of forming such materials, cutting elements, and tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller-cone earth-boring rotary drill bits include cones that are mounted on bearing pins extending from legs of a bit body such that each cone is capable of rotating about the bearing pin on which the cone is mounted. A plurality of cutting elements may be mounted to each cone of the drill bit.

The cutting elements used in earth-boring tools often include polycrystalline diamond compact (often referred to as "PDC") cutters, which are cutting elements that include a polycrystalline diamond (PCD) material. Such polycrystalline diamond cutting elements are formed by sintering and bonding together relatively small diamond grains or crystals under conditions of high pressure and high temperature, conventionally in the presence of a catalyst (such as cobalt, iron, nickel, or alloys and mixtures thereof), to form a layer of polycrystalline diamond material on a cutting element substrate. These processes are often referred to as high pressure/high temperature (or "HPHT") processes. Catalyst material is mixed with the diamond grains to reduce the amount of oxidation of diamond by oxygen and carbon dioxide during an HPHT process and to promote diamond-to-diamond bonding.

The cutting element substrate may include a cermet material (i.e., a ceramic-metal composite material) such as cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation.

Conventional PDC formation relies on the catalyst alloy, which sweeps through the compacted diamond feed during HPHT synthesis. Traditional catalyst alloys are cobalt-based with varying amounts of nickel, tungsten, and chromium to facilitate diamond intergrowth between the compacted diamond material. However, in addition to facilitating the formation of diamond-to-diamond bonds during HPHT sintering, these alloys also facilitate the formation of graphite from diamond during drilling. Formation of graphite can rupture diamond necking regions (i.e., grain boundaries) due to an approximate 57% volumetric expansion during the transformation. This phase transformation is known as "back-conversion" or "graphitization," and typically occurs at temperatures approaching 600° C. to 1,000° C., which temperatures may be experienced at the portions of the PDC contacting a subterranean formation during drilling applications. This mechanism, coupled with mismatch of the coefficients of thermal expansion of the metallic phase and diamond, is believed to account for a significant part of the failure of conventional PDC cutters to meet general performance criteria known as "thermal stability."

To reduce problems associated with different rates of thermal expansion and with back-conversion in polycrystalline diamond cutting elements, so-called "thermally stable" polycrystalline diamond (TSD) cutting elements have been developed. A TSD cutting element may be formed by leaching the catalyst material (e.g., cobalt) out from interstitial spaces between the diamond grains in the diamond table using, for example, an acid. Substantially all of the catalyst material may be removed from the diamond table, or only a portion may be removed. TSD cutting elements in which substantially all catalyst material has been leached from the diamond table have been reported to be thermally stable up to temperatures of about 1,200° C. It has also been reported, however, that fully leached diamond tables are relatively more brittle and substantially more vulnerable to failure under shear, compressive, and tensile stresses and impact than are non-leached diamond tables. In an effort to provide cutting elements having PDC diamond tables that are more thermally stable relative to non-leached diamond tables, but that are also relatively less brittle and vulnerable to shear, compressive, and tensile stresses relative to fully leached diamond tables, cutting elements have been provided that include a PDC diamond table in which the catalyst material has been leached from only a portion of the diamond table, for example, to a depth within the diamond table from the cutting face and a part of the side of the diamond table.

BRIEF SUMMARY

In some embodiments, a polycrystalline diamond compact includes a polycrystalline diamond material having a plurality of grains of diamond bonded to one another by inter-granular bonds and an ordered intermetallic gamma prime (γ') or κ-carbide phase disposed within interstitial spaces between the inter-bonded diamond grains. The ordered intermetallic gamma prime (γ') or κ-carbide phase includes a Group VIII metal, aluminum, and a stabilizer.

A method of forming polycrystalline diamond includes subjecting diamond particles in the presence of a metal material comprising a Group VIII metal and aluminum to a pressure of at least 4.5 GPa and a temperature of at least 1,000° C. to form inter-granular bonds between adjacent diamond particles, cooling the diamond particles and the metal material to a temperature below 500° C., and forming an ordered intermetallic gamma prime (γ') or κ-carbide phase adjacent the diamond particles. The ordered intermetallic gamma prime (γ') or κ-carbide phase includes a Group VIII metal, aluminum, and a stabilizer.

An earth-boring tool includes a bit body and a polycrystalline diamond compact secured to the bit body. The polycrystalline diamond compact includes a polycrystalline diamond material having a plurality of grains of diamond bonded to one another by inter-granular bonds and an ordered intermetallic gamma prime (γ') or κ-carbide phase disposed within interstitial spaces between the inter-bonded diamond grains. The ordered intermetallic gamma prime (γ') or κ-carbide phase includes a Group VIII metal, aluminum, and a stabilizer.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
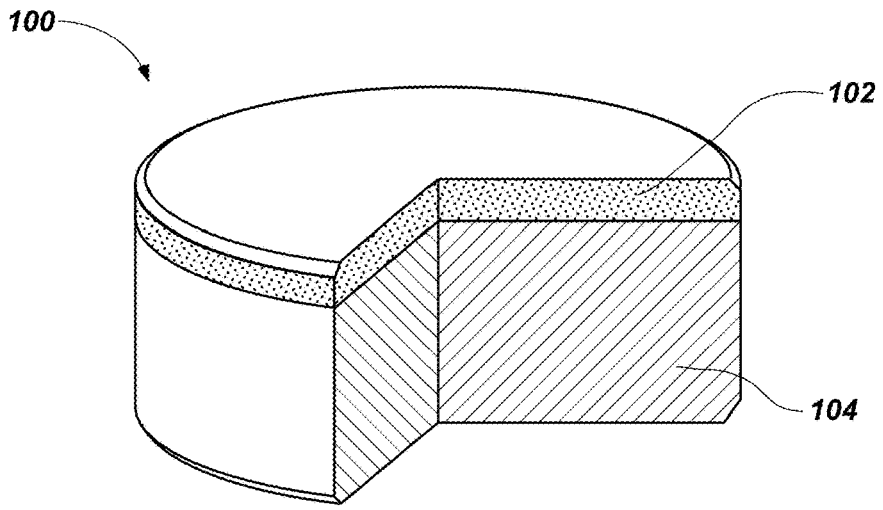
FIG. 1 is a partially cut-away perspective view of an embodiment of a cutting element (i.e., a polycrystalline compact) including a volume of polycrystalline hard material on a substrate.

The illustrations presented herein are not meant to be actual views of any particular material, apparatus, system, or method, but are merely idealized representations employed to describe certain embodiments. For clarity in description, various features and elements common among the embodiments may be referenced with the same or similar reference numerals.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," "over," "top," "bottom," "underlying," etc., is used for clarity and convenience in understanding the disclosure and accompanying drawings and does not connote or depend on any specific preference, orientation, or order, except where the context clearly indicates otherwise.

As used herein, the term "particle" means and includes any coherent volume of solid matter having an average dimension of about 500 μm or less. Grains (i.e., crystals) and coated grains are types of particles. As used herein, the term "nanoparticle" means and includes any particle having an average particle diameter of about 500 nm or less. Nanoparticles include grains in a polycrystalline hard material having an average grain size of about 500 nm or less.

As used herein, the term "hard material" means and includes any material having a Knoop hardness value of about 3,000 Kgf/mm$^2$ (29,420 MPa) or more. Hard materials include, for example, diamond and cubic boron nitride.

As used herein, the term "inter-granular bond" means and includes any direct atomic bond (e.g., covalent, metallic, etc.) between atoms in adjacent grains of material.

As used herein, the terms "nanodiamond" and "diamond nanoparticles" mean and include any single or polycrystalline or agglomeration of nanocrystalline carbon material comprising a mixture of sp-3 and sp-2 bonded carbon wherein the individual particle or crystal whether singular or part of an agglomerate is primarily made up of sp-3 bonds. Commercial nanodiamonds are typically derived from detonation sources (UDD) and crushed sources and can be naturally occurring or manufactured synthetically. Naturally occurring nanodiamond includes the natural lonsdaleite phase identified with meteoric deposits.

As used herein, the term "polycrystalline hard material" means and includes any material comprising a plurality of grains or crystals of the material that are bonded directly together by inter-granular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising inter-granular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 illustrates a cutting element 100, which may be formed as disclosed herein. The cutting element 100 includes a polycrystalline hard material 102. Typically, the polycrystalline hard material 102 may be polycrystalline diamond, but may include other hard materials instead of or in addition to polycrystalline diamond. For example, the polycrystalline hard material 102 may include cubic boron nitride. Optionally, the cutting element 100 may also include a substrate 104 to which the polycrystalline hard material 102 may be bonded after formation, or on which the polycrystalline hard material 102 is formed under the aforementioned HPHT conditions. For example, the substrate 104 may include a generally cylindrical body of cobalt-cemented tungsten carbide material, although substrates of different geometries and compositions may also be employed. The polycrystalline hard material 102 may be in the form of a table (i.e., a layer) of polycrystalline hard material 102 on the substrate 104, as shown in FIG. 1. The polycrystalline hard material 102 may be provided on (e.g., formed on or secured to) a surface of the substrate 104. In additional embodiments, the cutting element 100 may simply be a volume of the polycrystalline hard material 102 having any desirable shape, and may not include any substrate 104. The cutting element 100 may be referred to as "polycrystalline compact," or, if the polycrystalline hard material 102 includes diamond, as a "polycrystalline diamond compact."

Figure 2:
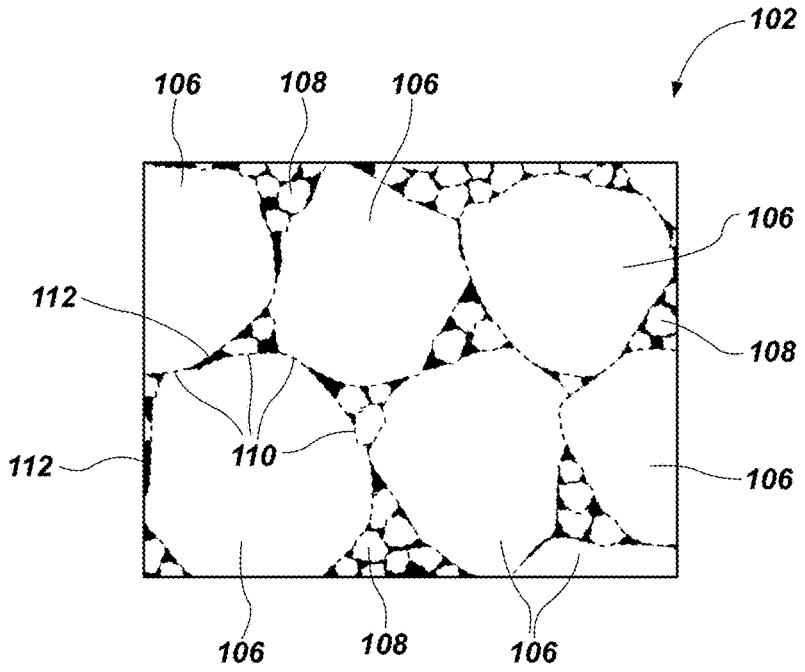
FIG. 2 is a simplified view illustrating how a microstructure of the polycrystalline hard material of the cutting element of FIG. 1 may appear under magnification.

As shown in FIG. 2, the polycrystalline hard material 102 may include interspersed and inter-bonded grains forming a three-dimensional network of hard material. Optionally, in some embodiments, the grains of the polycrystalline hard material 102 may have a multimodal (e.g., bi-modal, tri-modal, etc.) grain size distribution. For example, the polycrystalline hard material 102 may comprise a multi-modal grain size distribution as disclosed in at least one of U.S. Pat. No. 8,579,052, issued Nov. 12, 2013, and titled "Polycrystalline Compacts Including In-Situ Nucleated Grains, Earth-Boring Tools Including Such Compacts, and Methods of Forming Such Compacts and Tools;" U.S. Pat. No. 8,727,042, issued May 20, 2014, and titled "Polycrystalline Compacts Having Material Disposed in Interstitial Spaces Therein, and Cutting Elements Including Such Compacts;" and U.S. Pat. No. 8,496,076, issued Jul. 30, 2013, and titled "Polycrystalline Compacts Including Nanoparticulate Inclusions, Cutting Elements and Earth-Boring Tools Including Such Compacts, and Methods of Forming Such Compacts;" the disclosures of each of which are incorporated herein in their entireties by this reference.

For example, in some embodiments, the polycrystalline hard material 102 may include larger grains 106 and smaller grains 108. The larger grains 106 and/or the smaller grains 108 may have average particle dimensions (e.g., mean diameters) of less than 0.5 mm (500 μm), less than 0.1 mm (100 μm), less than 0.01 mm (10 μm), less than 1 μm, less than 0.1 μm, or even less than 0.01 μm. That is, the larger grains 106 and smaller grains 108 may each include micron-sized particles (grains having an average particle diameter in a range from about 1 μm to about 500 μm (0.5 mm)), submicron-sized particles (grains having an average particle diameter in a range from about 500 nm (0.5 μm) to about 1 μm), and/or nanoparticles (particles having an average particle diameter of about 500 nm or less). In some embodiments, the larger grains 106 may be micron-sized diamond particles, and the smaller grains 108 may be submicron diamond particles or diamond nanoparticles. In some embodiments, the larger grains 106 may be submicron diamond particles, and the smaller grains 108 may be diamond nanoparticles. In other embodiments, the grains of the polycrystalline hard material 102 may have a mono-modal grain size distribution. The polycrystalline hard material 102 may include direct inter-granular bonds 110 between the grains 106, 108, represented in FIG. 2 by dashed lines. If the grains 106, 108 are diamond particles, the direct inter-granular bonds 110 may be diamond-to-diamond bonds. Interstitial spaces are present between the inter-bonded grains 106, 108 of the polycrystalline hard material 102. In some embodiments, some of these interstitial spaces may include empty voids within the polycrystalline hard material 102 in which there is no solid or liquid substance (although a gas, such as air, may be present in the voids). An intermetallic or carbide material 112 may reside in some or all of the interstitial spaces unoccupied by the grains 106, 108 of the polycrystalline hard material 102.

As used herein, the term "grain size" means and includes a geometric mean diameter measured from a two-dimensional section through a bulk material. The geometric mean diameter for a group of particles may be determined using techniques known in the art, such as those set forth in Ervin E. Underwood, QUANTITATIVE STEREOLOGY, 103-105 (Addison-Wesley Publishing Company, Inc., 1970), the disclosure of which is incorporated herein in its entirety by this reference. As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a polycrystalline hard material 102 (e.g., a polished and etched surface of the polycrystalline hard material 102). Commercially available vision systems are often used with such microscopy systems, and these vision systems are capable of measuring the average grain size of grains within a microstructure.

Referring again to FIG. 2, the intermetallic or carbide material 112 may include a Group VIII metal (e.g., cobalt), aluminum, and a stabilizer. In some embodiments, the intermetallic or carbide material 112 may be a material in an ordered intermetallic gamma prime (γ') or κ-carbide phase. The intermetallic or carbide material 112 may be non-catalytic to the formation of inter-granular bonds 110 between grains of the polycrystalline hard material 102. The intermetallic or carbide material 112 may render the polycrystalline hard material 102 inherently more thermally stable than conventional polycrystalline materials having a catalyst material, because the intermetallic or carbide material 112 does not promote or catalyze the back-conversion of diamond to graphitic carbon. Therefore, polycrystalline hard material 102 in contact with the intermetallic or carbide material 112 may be protected from the catalytic effect a conventional catalyst that may be positioned in interstitial spaces within the polycrystalline hard material 102.

The stabilizer in the intermetallic or carbide material 112 may be any material formulated to cause the intermetallic or carbide material 112 to form a gamma prime or κ-carbide phase. For example, the stabilizer may include titanium (Ti), nickel (Ni), tungsten (W), or carbon (C). A gamma prime $Co_3Al$ phase within a binary Co—Al system is a metastable ordered metallic phase. Under ambient temperature and pressure conditions, the $Co_3Al$ structure is not stable and typically requires another element such as Ti, Ni, W, or C to stabilize the structure. That is, the intermetallic or carbide material 112 may form a solution at Co sites of the $Co_3Al$ structure, resulting in a $(Co_{3-n},W_n)Al$ phase, a $(Co_{3-n},Ni_n)Al$ phase, a $(Co_{3-n},W_n)Al$ phase, or a $Co_3Al\ C_m$ phase, where n and m are any positive numbers between 0 and 3, and 0 and 1, respectively.

Figure 3:
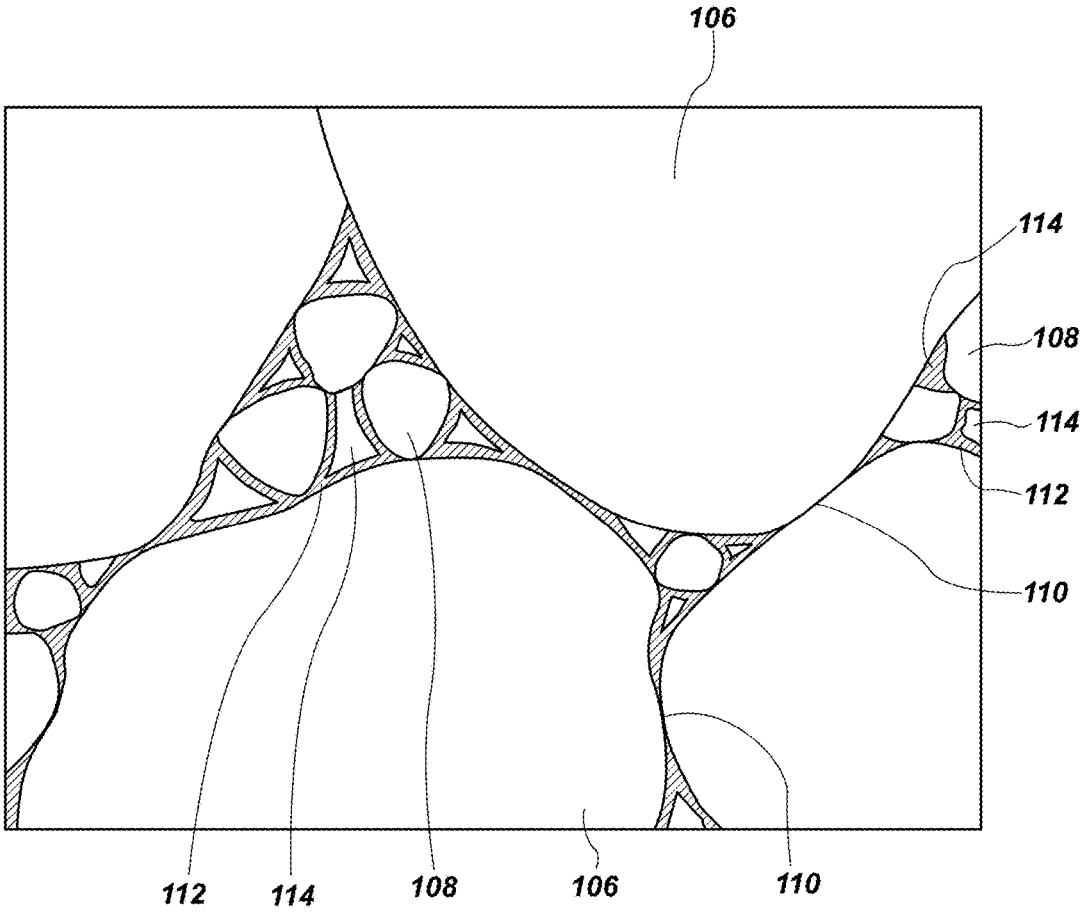
FIG. 3 is a simplified view illustrating how the microstructure of the polycrystalline hard material shown in FIG. 2 may appear under further magnification.

FIG. 3 illustrates how a portion of the polycrystalline hard material 102 shown in FIG. 2 may appear under further magnification. The polycrystalline hard material 102 may include distinct volumes of the intermetallic or carbide material 112 and of a catalyst material 114. For example, the grains 106, 108 of the polycrystalline hard material 102 may be substantially coated by the intermetallic or carbide material 112, and the catalyst material 114 may occupy interstitial spaces between the grains 106, 108 and adjacent the intermetallic or carbide material 112. In some embodiments, the catalyst material 114 may be a residue of a catalyst material that was used to form the polycrystalline hard material 102. In other embodiments, the catalyst material 114 may have been introduced to the polycrystalline hard material 102 during HPHT processing. The catalyst material 114 may be substantially separated from the grains 106, 108 by the intermetallic or carbide material 112. In some embodiments, some portions of the catalyst material 114 may be in contact with at least portions of the grains 106, 108. The catalyst material 114 may include one or more elemental Group VIII metals, such as iron, cobalt, and nickel, or any other material catalytic to the formation of inter-granular bonds between the grains 106, 108.

In some embodiments, the intermetallic or carbide material 112 may be substantially free of elemental forms of Group VIII metals, such as iron, cobalt, and nickel. These metals in elemental form are known to be catalytic to the reactions that form and decompose diamond. Therefore, if the intermetallic or carbide material 112 does not contain an appreciable amount of these metals in elemental form, the polycrystalline hard material 102 may be relatively more stable than polycrystalline hard materials that contain greater quantities of these metals in elemental form.

At least a portion of the intermetallic or carbide material 112 may exhibit a face-centered cubic (FCC) structure of space group Pm-3m (221) that remains stable even at room temperature. The stabilizer (e.g., Ti, Ni, W, or C) may occupy the (0,0,0), (0,½,½), or the (½,½,1/2) lattice positions of the FCC structure. The stabilizer may render the gamma prime or κ-carbide phase stable at ambient pressure and temperature conditions. Without the stabilizer, the gamma prime and κ-carbide phases may not be stable at ambient pressure and temperature conditions.

In a volume of polycrystalline hard material, the hard material typically occupies less than 100% of the total volume due to the inclusion of interstitial spaces. The polycrystalline hard material 102 may include at least about 90% hard material by volume, such as at least about 94% hard material by volume, at least about 95% hard material by volume, at least about 96% hard material by volume, or even at least about 97% hard material by volume. In general, higher volume fractions of hard materials may exhibit better cutting performance.

Figure 4:
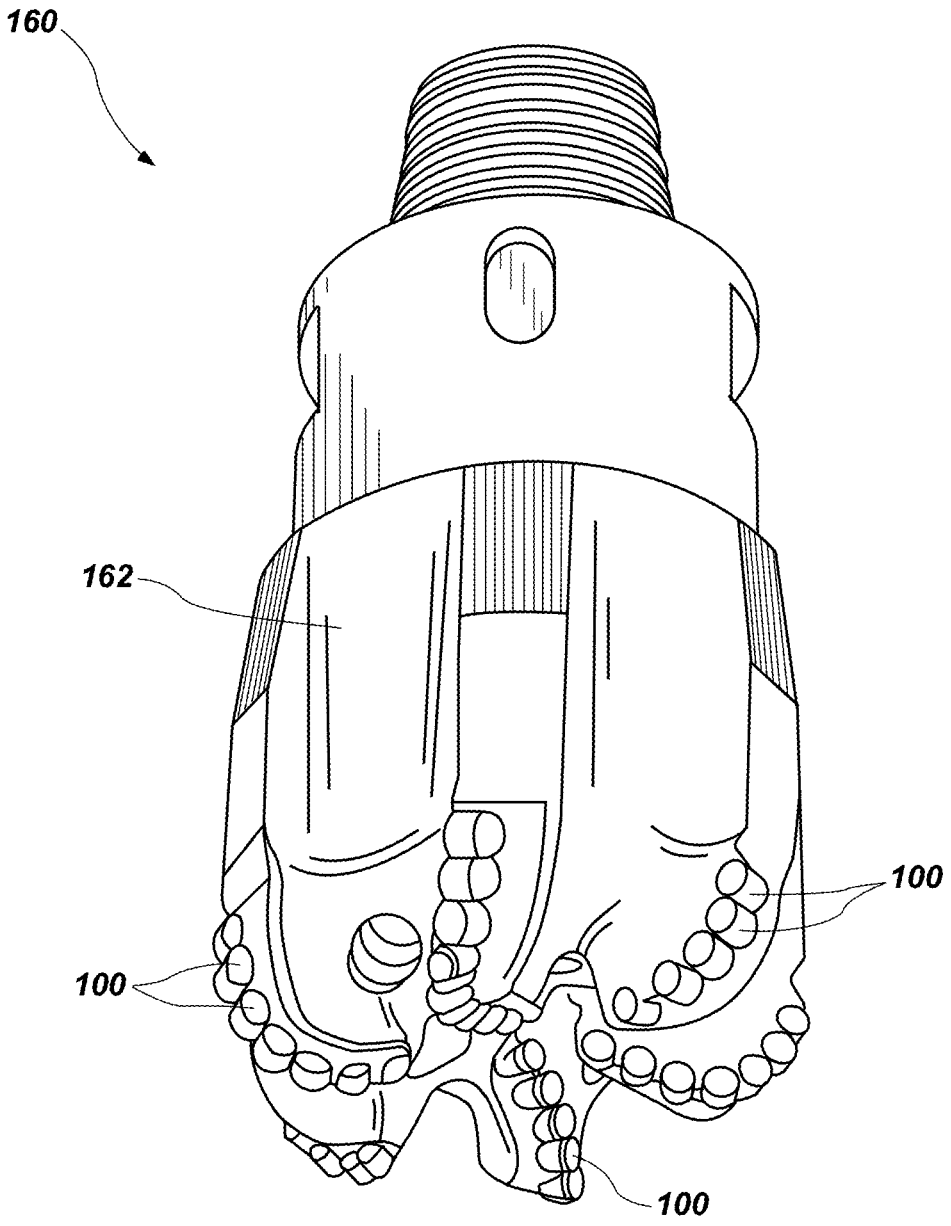
FIG. 4 illustrates an earth-boring rotary drill bit comprising cutting elements as described herein.

Embodiments of cutting elements 100 (FIG. 1) that include polycrystalline hard material 102 fabricated as described herein may be mounted to earth-boring tools and used to remove subterranean formation material. FIG. 4 illustrates a fixed-cutter earth-boring rotary drill bit 160. The drill bit 160 includes a bit body 162. One or more cutting elements 100 as described herein may be mounted on the bit body 162 of the drill bit 160. The cutting elements 100 may be brazed to or otherwise secured within pockets formed in the outer surface of the bit body 162. Other types of earth-boring tools, such as roller cone bits, percussion bits, hybrid bits, reamers, etc., also may include cutting elements 100 as described herein.

Figure 5:
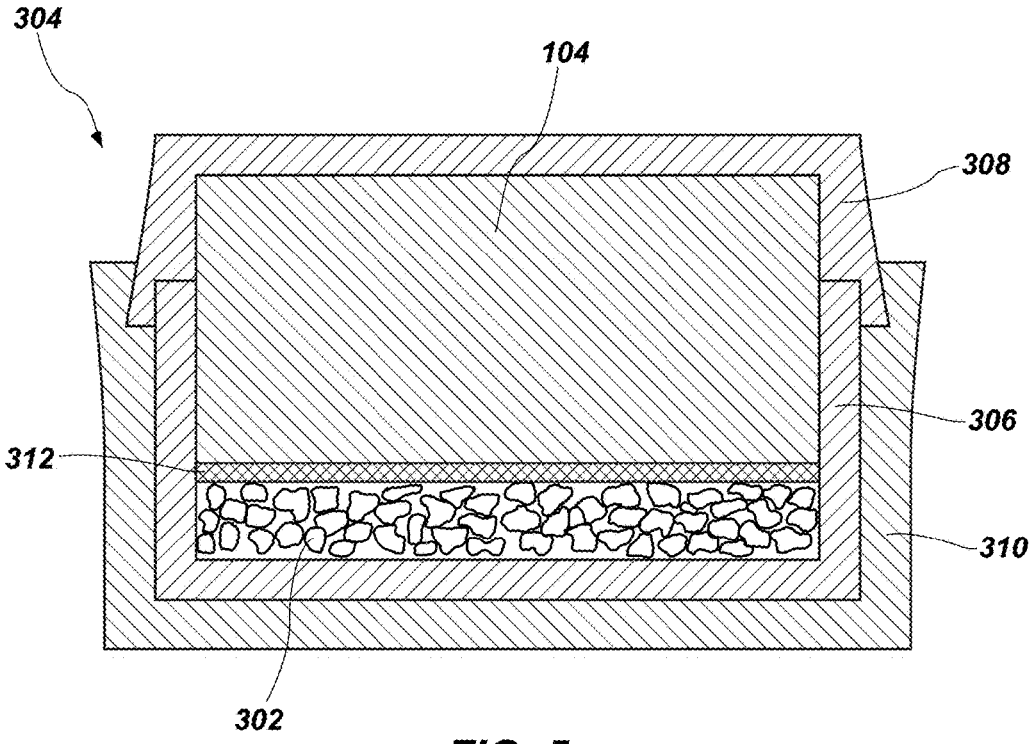
FIG. 5 is a simplified cross-sectional view illustrating materials used to form the cutting element of FIG. 1 in a container in preparation for subjecting the container to an HPHT sintering process.

Referring to FIG. 5, hard particles 302 (i.e., particles of hard material) may be positioned within a container 304 (e.g., a metal canister). Typically, the hard particles 302 may be packed into the container 304 to limit the unoccupied volume. The hard particles 302 may include, for example, grains or crystals of diamond (e.g., diamond grit), which will ultimately form the grains 106, 108 in the sintered polycrystalline hard material 102 (FIG. 2). The container 304 may include an inner cup 306 in which the hard particles 302 may be provided. The hard particles 302 may be mixed with or otherwise placed adjacent an alloy material or combination of metals and/or alloys formulated to form the intermetallic or carbide material 112 (FIGS. 2 & 3) upon sintering. For example, in some embodiments, a substrate 104 (e.g., as shown in FIG. 1) and/or a disk 312 (e.g., a billet or foil) that includes one or more elements of the intermetallic or carbide material 112 may also be provided in the inner cup 306 over or under the hard particles 302, and may ultimately be encapsulated in the container 304. In other embodiments, the intermetallic or carbide material 112 may be granulated and subsequently deposited into the inner cup 306. In yet other embodiments, the intermetallic or carbide material 112 may be coated onto surfaces of the substrate 104. The container 304 may further include a top cover 308 and a bottom cover 310, which may be assembled and bonded together (e.g., swage bonded) around the inner cup 306 with the hard particles 302 and the optional substrate 104 therein.

The disk 312, if present, or other metallic material may include one or more elements of the intermetallic or carbide material 112 (FIGS. 2 and 3) discussed above. For example the disk 312 may include aluminum, a catalyst, or a stabilizer (e.g., titanium, nickel, tungsten, or carbon). In some embodiments, the disk 312 may include multiple layers of material, such as a layer of cobalt, a layer of aluminum, etc. Different layers of material may have different thicknesses, depending on the desired final alloy composition. In some embodiments, the elements of the intermetallic or carbide material 112 may be alloyed with one another prior to introduction to the container 304. In some embodiments, the elements of the intermetallic or carbide material 112 may be granulated and mixed with one another prior to introduction to the container 304. In other embodiments, particles including such elements may be admixed with the hard particles 302 before or after the hard particles 302 are placed in the container 304, coated onto the hard particles 302, etc.

The disk 312 or other metallic material may be formulated to include an approximately 3:1 molar ratio of cobalt to aluminum, such that a majority of the cobalt and aluminum will form a $Co_3Al$ phase during sintering. For example, the disk 312 or other metallic material may include from about 0.1 mol % to about 24 mol % aluminum, and from about 0.3 mol % to about 50 mol % aluminum. In some embodiments, the disk 312 or other metallic material may include from about 1.0 mol % to about 15 mol % aluminum, and from about 3.0 mol % to about 45 mol % aluminum. The disk 312 or other metallic material may include other elements, such as the stabilizer or an inert element (i.e., an element that does not form a part of the crystal structure of the gamma prime or κ-carbide phase of the intermetallic or carbide material 112 and that is non-catalytic toward the grains 106, 108). The disk 312 or other metallic material may exhibit a melting point of less than about 1,100° C. at atmospheric pressure, less than about 1,300° C. at atmospheric pressure, or less than about 1,500° C. at atmospheric pressure.

The container 304 with the hard particles 302 therein may be subjected to an HPHT sintering process to form a polycrystalline hard material (e.g., the polycrystalline hard material 102 shown in FIG. 1). For example, the container 304 may be subjected to a pressure of at least about 4.5 GPa and a temperature of at least about 1,000° C. In some embodiments, the container 304 may be subjected to a pressure of at least about 5.0 GPa, at least about 5.5 GPa, at least about 6.0 GPa, or even at least about 6.5 GPa. For example, the container 304 may be subjected to a pressure from about 7.8 GPa to about 8.5 GPa. The container 304 may be subjected to a temperature of at least about 1,100° C., at least about 1,200° C., at least about 1,300° C., at least about 1,400° C., or even at least about 1,700° C.

The HPHT sintering process may cause the formation of inter-granular (e.g., diamond-to-diamond) bonds between the hard particles 302 so as to form a polycrystalline compact from the hard particles 302. If a substrate 104 is within the container 304, catalyst material (e.g., cobalt) may sweep through the hard particles 302 from the substrate 104 and catalyze the formation of inter-granular bonds. In some embodiments, the hard particles 302 may be admixed or coated with the catalyst material, such that the catalyst material need not sweep through the volume of hard particles 302.

The HPHT sintering process may also cause elements within the container 304 to transform into an ordered intermetallic gamma prime (γ') or κ-carbide phase adjacent the diamond particles. For example, the intermetallic or carbide material 112 may form from cobalt sweeping or diffusing through the hard particles 302 in combination with aluminum and a stabilizer. The aluminum and/or the stabilizer may also sweep through the hard particles 302 from the disk 312 (if present). Alternatively, the aluminum and/or the stabilizer may be placed into contact with the hard particles 302 before sintering. For example, particles of the aluminum and/or the stabilizer may be dispersed throughout the hard particles 302 before the HPHT sintering begins, or the hard particles 302 may be coated with the aluminum and/or the stabilizer. The material in the γ' or κ-carbide phase may at least partially encapsulate or coat surfaces of the hard particles 302 during the HPHT sintering process, such that when the material cools, surfaces of the grains 106, 108 are at least partially covered with the intermetallic or carbide material 112 (see FIGS. 2 & 3). The intermetallic or carbide material 112 may therefore help prevent further back-conversion of the grains 106, 108 to other forms or phases (e.g., from diamond to graphitic or amorphous carbon).

The stabilizer may be dissolved in a mixture of cobalt and aluminum during the HPHT sintering process or during a processing step prior to HPHT. The material may form a stabilized $Co_3Al$ phase structure having an FCC $L1_2$ (space group Pm-3m) ordered/disordered structure, such as a $(Co_{3-n}Ti_n)_3Al$ phase, a $(Co_{3-n}Ni_n)Al$ phase, or a $Co_{3-n}W_n)_3$ Al phase. For the case of carbon acting as a stabilizer, the Co and Al may occupy similar sites as the FCC $L1_2$ order/disorder structure, mentioned above, with the carbon occupying the octahedral lattice position having a stoichiometry of $Co_3Al\ C_m$. This structure is an $E2_1$ (space group Pm-3m) ordered/disorder carbide structure differing from the traditional γ' having the order/disorder FCC $L1_2$ structure.

During liquid-phase sintering of diamond, the alloy material may dissolve an appreciable amount of carbon from the diamond or other carbon phase. For the FCC $L1_2$ structure, atoms of Ti, Ni, or W may stabilize the $Co_3Al$ ordered/disorder structure on the corner or face centered lattice sites. Additionally, a carbon atom may occupy the octahedral site of an FCC-$E2_1$ structure, which may remain stable even at room temperature.

The container 304 and the material therein may be cooled to a temperature below 500° C., such as to a temperature below 250° C. or to room temperature, while maintaining at least a portion of the alloy material in the γ' or κ-carbide phase. The stabilizer may keep the γ' or κ-carbide phase thermodynamically stable as the material cools, such that the γ' or κ-carbide phase may continue to prevent conversion of the grains 106, 108 and degradation of the polycrystalline hard material 102.

The presence of the intermetallic or carbide material 112 in the γ' or κ-carbide phase may render the resulting polycrystalline hard material 102 thermally stable without the need for leaching or otherwise removing the catalyst material 114 from the monolithic polycrystalline hard material 102. For example, all or substantially all the cobalt or other catalyst material adjacent the hard particles 302 during HPHT sintering may be converted into the intermetallic or carbide material 112 in the γ' or κ-carbide phase. In certain embodiments, the catalyst material 114 may not be present after the HPHT sintering process, because the catalyst material used in the sintering process may be entirely or substantially incorporated into the intermetallic or carbide material 112.

Use of an intermetallic or carbide material 112 as described herein may impart certain benefits to polycrystalline hard materials 102. For example, the intermetallic or carbide material 112, stabilized in a γ' or κ-carbide phase, may exhibit inert (i.e., non-catalytic) behavior toward the polycrystalline hard material 102, even at elevated temperatures, such as above about 400° C. For example, the intermetallic or carbide material 112 may not promote carbon transformations (e.g., graphite-to-diamond or vice versa), and it may displace catalytic materials from the cutting element 100. Thus, after the polycrystalline hard material 102 has been sintered and cooled with the intermetallic or carbide material 112, further changes to the crystalline structure of the polycrystalline hard material 102 may occur at negligible rates. The cutting element 100 may exhibit significantly increased abrasion resistance and thermal stability in a range between the temperature at which back-conversion typically occurs (e.g., between 600° C. and 1,000° C. for catalysts based on Fe, Co, or Ni) and the melting temperature of the intermetallic or carbide material 112. For example, if the melting temperature of the intermetallic or carbide material 112 is 1,200° C., the cutting element 100 may be thermally and physically stable even at temperatures of 1,100° C. or higher. Thus, a drill bit with such a cutting element 100 may operate in relatively harsher conditions than conventional drill bits with lower rates of failure and costs of repair. Alternatively, a drill bit with such cutting elements 100 may exhibit lower wear of the cutting elements 100, allowing for reduced weight-on-bit for subterranean material removal of the drill bit.

Though this disclosure has generally discussed the use of alloy materials including a complex of cobalt and aluminum, other metals may be substituted for all or a portion of the cobalt or aluminum to form a stabilized non-catalytic phase.

For example, in a container 304 in which the disk 312 is a pre-alloyed binary (Co—Al) or ternary (Co—Al-M, wherein M represents a metal) foil and the substrate 104 is a W—Co substrate, tungsten from the substrate may alloy with the binary (Co—Al) or ternary (Co—Al-M) to form a Co—Al—W or Co—Al—W-M alloy, respectively. Additionally, pre-alloying with carbon in each of the above scenarios is possible prior to HPHT cell loading. In the presence of diamond, the alloy swept into the diamond grains would include Co—Al—W—C or Co—Al—W-M-C. Also, other materials may be included in the substrate, such as Cr. In such embodiments, the alloy would include Co—Al—W—Cr—C, or, in the presence of diamond, Co—Al—W—Cr-M-C. The M may be replaced with a suitable element for stabilizing the γ' or κ-carbide ordered phase. For instance, the presence of Ni promotes the segregation of Al to the diamond interface and stabilizes the γ' or κ-carbide phase as $(Co,Ni)_3Al$. W and Cr appear to remain in solution, without gross carbide precipitation. Moreover, though WC may still be present at the diamond interface, W and Cr appear to remain largely in solution.

Without being bound by theory, the ordered γ' or κ-carbide phase appears to form when atoms in the lattice of the more-plentiful element are replaced by atoms of the less-plentiful element in the intermetallic, and when the replacement atom is positioned in a regular position throughout the lattice. In contrast, a disordered γ' or κ-carbide phase would occur when the replacement atom is substituted into the lattice, but in irregular positions. Detection of whether a lattice exhibits an ordered or a disordered configuration can be demonstrated using X-ray diffraction techniques or in detection of magnetic phases.

The ordered γ' or κ-carbide phase can be manufactured by subjecting the intermetallic to thermodynamic conditions in which the γ' or κ-carbide phase is stable in the ordered configuration. In a conventionally-known HPHT cycles, the temperature of the polycrystalline diamond body is typically decreased as rapidly as possible to minimize manufacturing times while avoiding cracking in the diamond layer. In some embodiments of the present disclosure, the HPHT cycle is controlled to hold the temperature of the polycrystalline diamond body, and by extension, the intermetallic phase present in the interstices between diamond grains, below an ordered-disordered transition temperature at the working pressure for a time sufficient to convert at least a portion of the intermetallic into the ordered γ' or κ-carbide phase. In some embodiments, the intermetallic may be quenched to maintain the disordered γ' or κ-carbide phase during the HPHT cycle.

The ordered intermetallic γ' or κ-carbide phase may be a thermodynamically stable phase at ambient pressure and temperate, as well as at temperatures and pressures of use, for example, at temperatures and pressures experienced during downhole drilling. Without being bound by theory, it is believed that the presence of the thermodynamically stable ordered phase is beneficial to the thermal stability of the cutting tool. As the ordered γ' or κ-carbide phase is the thermodynamically stable phase, phase transition from the disordered to the ordered phase is not expected when the cutting element is subject to the temperatures and pressures associated with use. Additionally, it is believed that the ordered γ' or κ-carbide phase is less likely to catalyze graphitization of the diamond during usage than that of the disordered, metastable γ' or κ-carbide phase.

The metallic materials disclosed herein, in the liquid state, may promote diamond nucleation and growth. Upon cooling, the metallic material may nucleate and grow to form the intermetallic or carbide material 112 in the γ' or κ-carbide phase at the interface of diamond grains. The intermetallic or carbide material 112 may suppress back-conversion better than leaching of conventional PDC cutting elements because the intermetallic or carbide material 112 may be evenly distributed through the cutting element 100. In comparison, leaching typically occurs from a face of a cutting element, and therefore residual cobalt remains in portions of polycrystalline hard materials. Further, certain interstitial spaces of polycrystalline hard materials may be blocked following the HPHT sintering process, and may be inaccessible by a leaching medium. Accordingly, residual cobalt may remain within the blocked interstitial spaces of otherwise fully leached polycrystalline hard materials.

Additionally, the composition of the intermetallic or carbide material 112 may be varied to adjust its melting point. Without a significant increase in the melting point of the intermetallic or carbide material 112, an alloy of approximately 13.5% Al by weight may completely consume any residual cobalt solid solution. Thus, a cutting element 100 having such an intermetallic or carbide material 112 may be an inherently thermally stable product without leaching.

EXAMPLES

Example 1: Forming a PDC Cutting Element

Figure 6:
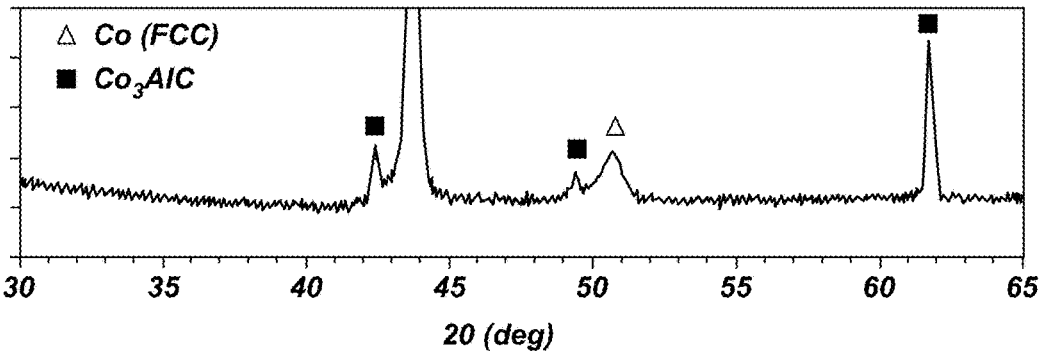
FIG. 6 is an XRD (X-ray Diffraction) spectrum of a sample of a polycrystalline material according to an embodiment.

Diamond grains were placed in a container as shown in FIG. 5. The diamond grains had a mean diameter of 9 μm. An alloy disk of aluminum (9% by weight) and cobalt (91% by weight) was placed over the diamond grains, and a cobalt-cemented tungsten carbide substrate was placed over the disk. The container was sealed, and the particle mixture, foil, and substrate were subjected to HPHT sintering at about 8.0 GPa and 1,625° C. The resulting polycrystalline diamond cutting element was analyzed with X-ray diffraction (XRD) to determine chemical composition of the diamond table, as shown in FIG. 6. The XRD spectrum indicated that the diamond table contained diamond, cobalt, and $Co_3AlC_n$.

Figure 7:
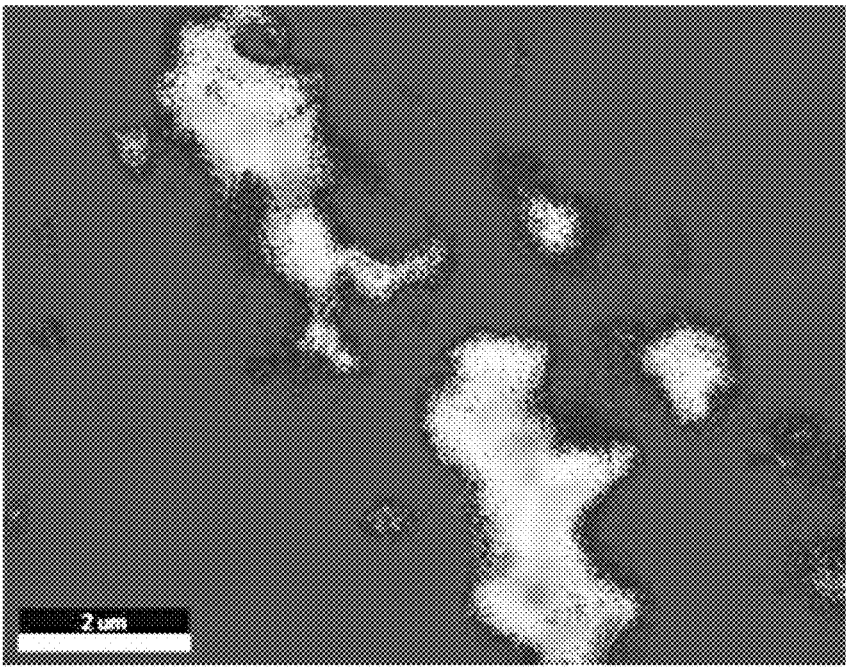
FIG. 7 is an EDS (Energy Dispersive Spectroscopy) map of a sample of a polycrystalline material according to an embodiment.

Energy-dispersive spectroscopy (EDS) and scanning electron microscopy (SEM) were used to determine the distribution of phases in the diamond table. FIG. 7 shows two phases of material in addition to diamond. Without being bound to any particular theory, it appears that a κ-carbide phase of $Co_3AlC$ forms adjacent the diamond phase, and metal pools form in the material, in a core-shell structure. The metal pools appear to be a cobalt-rich phase generally separated from the diamond phase by the κ-carbide phase of $Co_3AlC$.

Further evidence of possible growth of the $Co_3AlC$ phase from the diamond interface is the large $Co_3AlC$ crystalline peak observed in FIG. 6, which is evidence of a preferred crystallographic orientation. The preference for this phase to grow from the diamond may allow the ordered metallic κ-carbide phase to form a barrier between the diamond and cobalt-rich phase. Without being bound to any particular theory, it appears that this structure may suppress graphitization (i.e., back-conversion of diamond to graphite) during drilling. Hence, the PDC may be more thermally stable than an unleached Co—W swept PDC. Quantitative microstructure measurements suggest diamond density and contiguity are similar to conventional PDCs not having the Co—Al based alloy. The PDC was determined to be about 95.3% diamond by volume, about 3.7% cobalt in a FCC phase by volume, and about 1.0% $Co_3AlC_n$ by volume. Furthermore, microscopic views of the material appear to show that the $Co_3AlC_n$ is distributed throughout the PDC.

Example 2: Boring Mill Experiment

A vertical boring mill experiment was conducted on the PDC cutting element formed in Example 1 and with a conventional unleached cutting element (i.e., a cutting element formed in the same manner, but without the cobalt-aluminum disk).

Each cutting element was held in a vertical turret lathe ("VTL") to machine granite. Parameters of the VTL test may be varied to replicate desired test conditions. In this Example, the cutting elements were configured to remove material from a Barre white granite workpiece. The cutting elements were positioned with a 15° back-rake angle relative to the workpiece surface, at a nominal depth of cut of 0.25 mm. The infeed of the cutting elements was set to a constant rate of 7.6 mm/revolution with the workpiece rotating at 60 RPM. The cutting elements were water cooled.

The VTL test introduces a wear scar into the cutting elements along the position of contact between the cutting elements and the granite. The size of the wear scar is compared to the material removed from the granite workpiece to evaluate the abrasion resistance of the cutting elements. The respective performance of multiple cutting elements may be evaluated by comparing the rate of wear scar growth and the material removal from the granite workpiece.

Figure 8:
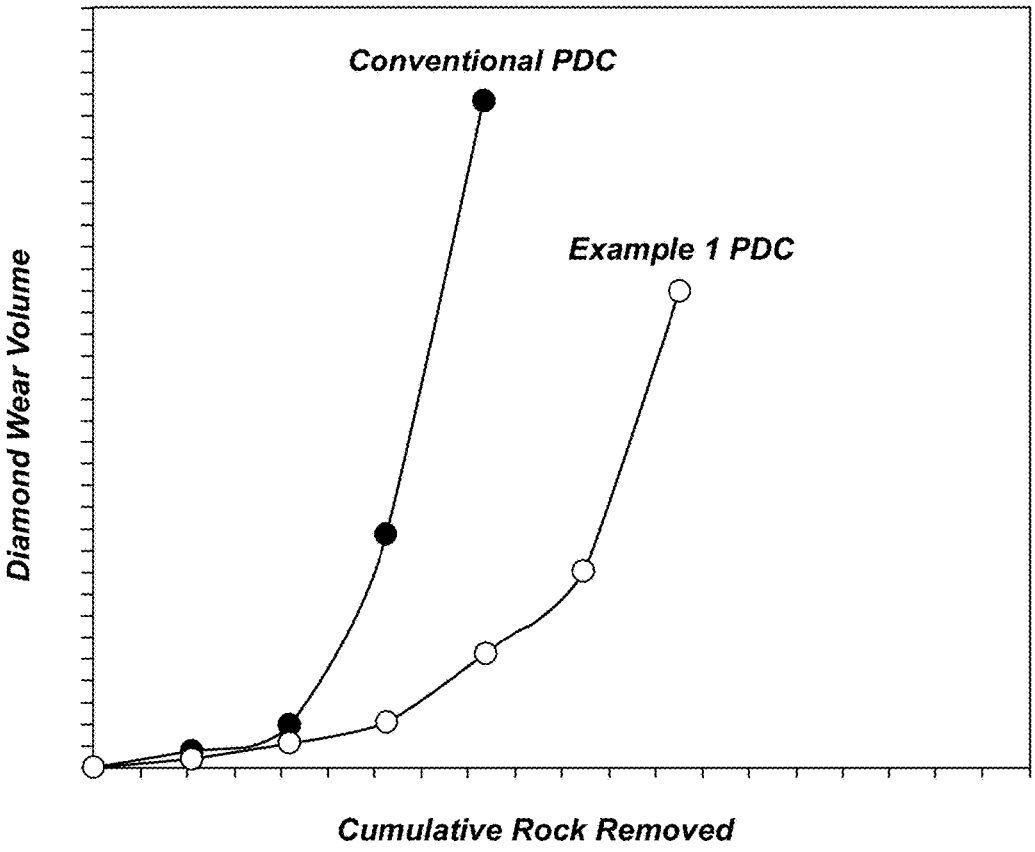
FIG. 8 is chart showing the relative wear of a PDC according to an embodiment with a conventional PDC.

FIG. 8 shows that nearly 100% more rock was removed during the VTL test for an equivalent wear scar using the PDC of Example 1 as compared with the baseline PDC platform. Hence, during this combined thermo-mechanical cutting test, the thermal stability appears to have been enhanced by preferentially growing a stable ordered phase from the diamond interface.

Additional non-limiting example embodiments of the disclosure are described below.

Embodiment 1

A polycrystalline diamond compact comprising a polycrystalline diamond material comprising a plurality of grains of diamond bonded to one another by inter-granular bonds; and an intermetallic gamma prime (γ') or κ-carbide phase disposed within interstitial spaces between the inter-bonded diamond grains. The gamma prime (γ') or κ-carbide phase comprises a Group VIII metal, aluminum, and a stabilizer.

Embodiment 2

The polycrystalline diamond compact of Embodiment 1, wherein the grains of diamond comprise nanodiamond grains.

Embodiment 3

The polycrystalline diamond compact of Embodiment 1 or Embodiment 2, wherein the stabilizer comprises a material selected from the group consisting of titanium, nickel, tungsten, and carbon.

Embodiment 4

The polycrystalline diamond compact of any of Embodiments 1 through 3, wherein the gamma prime (γ') or κ-carbide phase comprises a metastable $Co_3Al$ phase stabilized by the stabilizer.

Embodiment 5

The polycrystalline diamond compact of any of Embodiments 1 through 4, wherein the gamma prime (γ') or κ-carbide phase comprises a metastable $(Co_xNi_{3-x})Al$ phase stabilized by the stabilizer.

Embodiment 6

The polycrystalline diamond compact of any of Embodiments 1 through 5, wherein the stabilizer comprises carbon.

Embodiment 7

The polycrystalline diamond compact of any of Embodiments 1 through 6, wherein the gamma prime (γ') or κ-carbide phase exhibits an ordered face-centered cubic structure.

Embodiment 8

The polycrystalline diamond compact of any of Embodiments 1 through 7, wherein the polycrystalline diamond material is disposed over a substrate comprising the Group VIII metal.

Embodiment 9

The polycrystalline diamond compact of any of Embodiments 1 through 8, wherein the polycrystalline diamond material is substantially free of elemental iron, cobalt, and nickel.

Embodiment 10

The polycrystalline diamond compact of any of Embodiments 1 through 9, wherein the polycrystalline diamond compact comprises at least 94% diamond by volume.

Embodiment 11

The polycrystalline diamond compact of any of Embodiments 1 through 10, wherein the alloy exhibits a melting point of less than about 1,500° C. at atmospheric pressure.

Embodiment 12

The polycrystalline diamond compact of any of Embodiments 1 through 11, further comprising a catalyst material disposed in interstitial spaces between the grains of diamond, the catalyst material substantially separated from the polycrystalline diamond material by the intermetallic gamma prime (γ') or κ-carbide phase.

Embodiment 13

The polycrystalline diamond compact of any of Embodiments 1 through 12, wherein the gamma prime (γ') or κ-carbide phase comprises a metastable $Co_xAl_y$ phase having less than about 13% Co by weight.

Embodiment 14

The polycrystalline diamond compact of any of Embodiments 1 through 14, wherein the gamma prime (γ') or κ-carbide phase comprises a metastable $Co_xAl_y$ phase having less than about 50 mol % Al.

Embodiment 15

The polycrystalline diamond compact of any of Embodiments 1 through 14, wherein the intermetallic gamma prime (γ') or κ-carbide phase is structurally ordered.

Embodiment 16

The polycrystalline diamond compact of any of Embodiments 1 through 14, wherein the intermetallic gamma prime (γ') or κ-carbide phase is structurally disordered.

Embodiment 17

A method of forming polycrystalline diamond comprising subjecting diamond particles in the presence of a metal material comprising a Group VIII metal and aluminum to a pressure of at least 4.5 GPa and a temperature of at least 1,000° C. to form inter-granular bonds between adjacent diamond particles, cooling the diamond particles and the metal material to a temperature below an ordered-disordered transition temperature, and forming an ordered intermetallic gamma prime (γ') or κ-carbide phase adjacent the diamond particles. The ordered intermetallic gamma prime (γ') or κ-carbide phase comprises the Group VIII metal, aluminum, and a stabilizer.

Embodiment 18

The method of Embodiment 17, further comprising selecting the stabilizer to comprise at least one element selected from the group consisting of titanium, nickel, tungsten, and carbon.

Embodiment 19

The method of Embodiment 17 or Embodiment 18, wherein subjecting diamond particles to a pressure of at least 4.5 GPa and a temperature of at least 1,000° C. comprises dissolving the stabilizer in a mixture of the Group VIII metal and the aluminum.

Embodiment 20

The method of any of Embodiments 17 through 19, wherein dissolving the stabilizer in a mixture of the Group VIII metal and the aluminum comprises dissolving carbon originating from the diamond particles into a molten alloy comprising the Group VIII metal and the aluminum.

Embodiment 21

The method of any of Embodiments 17 through 20, wherein forming an ordered intermetallic gamma prime (γ') or κ-carbide phase comprises forming a metastable $Co_3Al$ phase stabilized by the stabilizer.

Embodiment 22

The method of any of Embodiments 17 through 21, wherein forming an ordered intermetallic gamma prime (γ') or κ-carbide phase comprises forming a metastable $(Co_xNi_{3-x})Al$ phase stabilized by the stabilizer.

Embodiment 23

The method of any of Embodiments 17 through 22, further comprising admixing the diamond particles with particles comprising at least one material selected from the group consisting of the Group VIII metal, the aluminum, and the stabilizer.

Embodiment 24

The method of any of Embodiments 17 through 23, further comprising disposing the diamond particles in a container with a metal foil comprising at least one material selected from the group consisting of the Group VIII metal, the aluminum, and the stabilizer.

Embodiment 25

The method of any of Embodiments 17 through 24, further comprising forming a thermally stable polycrystalline diamond compact comprising the diamond particles without leaching.

Embodiment 26

The method of any of Embodiments 17 through 25, further comprising forming the polycrystalline diamond in the form of a finished cutting element comprising a diamond table including the ordered intermetallic gamma prime (γ') or κ-carbide phase comprising the Group VIII metal, aluminum, and the stabilizer.

Embodiment 27

The method of any of Embodiments 17 through 26, further comprising at least substantially entirely filling interstitial spaces between the diamond particles with the gamma prime (γ') or κ-carbide phase.

Embodiment 28

The method of any of Embodiments 17 through 27, further comprising coating the diamond particles with at least one material selected from the group consisting of the Group VIII metal, the aluminum, and the stabilizer.

Embodiment 29

An earth-boring tool comprising a bit body and a polycrystalline diamond compact secured to the bit body. The polycrystalline diamond compact comprises any of Embodiments 1 through 16.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A polycrystalline diamond compact, comprising:

a polycrystalline diamond material comprising a plurality of grains of diamond bonded to one another by intergranular bonds; and a structurally ordered intermetallic gamma prime (γ') or κ-carbide phase disposed within interstitial spaces between the inter-bonded diamond grains, the structurally ordered intermetallic gamma prime (γ') or κ-carbide phase comprising a Group VIII metal, aluminum, and a stabilizer.

2. The polycrystalline diamond compact of claim 1, wherein the stabilizer comprises a material selected from the group consisting of titanium, nickel, tungsten, and carbon.

3. The polycrystalline diamond compact of claim 1, wherein the structurally ordered intermetallic gamma prime (γ') or κ-carbide phase comprises a metastable $Co_3Al$ phase stabilized by the stabilizer.

4. The polycrystalline diamond compact of claim 1, wherein the structurally ordered intermetallic gamma prime (γ') or κ-carbide phase comprises a metastable $(Co_xNi_{3-x})Al$ phase stabilized by the stabilizer.

5. The polycrystalline diamond compact of claim 1, wherein the stabilizer comprises carbon.

6. The polycrystalline diamond compact of claim 1, wherein the structurally ordered intermetallic gamma prime (γ') or κ-carbide phase exhibits an ordered face-centered cubic structure.

7. The polycrystalline diamond compact of claim 1, wherein the polycrystalline diamond material is disposed over a substrate comprising the Group VIII metal.

8. The polycrystalline diamond compact of claim 1, wherein the polycrystalline diamond material is substantially free of elemental iron, cobalt, and nickel.

9. The polycrystalline diamond compact of claim 1, wherein the structurally ordered intermetallic gamma prime (γ') or κ-carbide phase comprises a metastable $Co_xAl_y$ phase having less than about 13% Co by weight.

10. The polycrystalline diamond compact of claim 1, wherein the structurally ordered intermetallic gamma prime (γ') or κ-carbide phase comprises a metastable $CO_xAl_y$ phase having less than about 50 mol% Al.

11. The polycrystalline diamond compact of claim 1, wherein the structurally ordered intermetallic gamma prime (γ') or κ-carbide phase comprises a metastable $(Co,Ni)_3Al$ phase stabilized by the stabilizer.

12. The polycrystalline diamond compact of claim 1, wherein the structurally ordered intermetallic gamma prime (γ') or κ-carbide phase comprises an alloy of about 13.5% Al by weight.

13. The polycrystalline diamond compact of claim 1, wherein the inter-bonded diamond grains are at least substantially coated by the structurally ordered intermetallic gamma prime (γ') or κ-carbide phase within the interstitial spaces, the structurally ordered intermetallic gamma prime (γ') or κ-carbide phase providing a barrier between the inter-bonded diamond grains and any catalyst material located within the interstitial spaces.

14. A polycrystalline diamond compact, comprising:

a polycrystalline diamond material comprising a plurality of grains of diamond bonded to one another by inter-granular bonds; and an intermetallic gamma prime (γ') or κ-carbide phase disposed within interstitial spaces between the inter-bonded diamond grains, the intermetallic gamma prime (γ') or κ-carbide phase comprising a Group VIII metal, aluminum, and a stabilizer, wherein the intermetallic gamma prime (γ') or κ-carbide phase is structurally ordered.

15. A polycrystalline diamond compact, comprising:

a polycrystalline diamond material comprising a plurality of grains of diamond bonded to one another by inter-granular bonds; and an intermetallic gamma prime (γ') or κ-carbide phase disposed within interstitial spaces between the inter-bonded diamond grains, the intermetallic gamma prime (γ') or κ-carbide phase comprising a Group VIII metal, aluminum, and a stabilizer, wherein the intermetallic gamma prime (γ') or κ-carbide phase is structurally disordered.

16. An earth-boring tool, comprising:

a bit body; and a polycrystalline diamond compact secured to the bit body, the polycrystalline diamond compact comprising:

a polycrystalline diamond material comprising a plurality of grains of diamond bonded to one another by inter-granular bonds; and an intermetallic gamma prime (γ') or κ-carbide phase disposed within interstitial spaces between the inter-bonded diamond grains, the intermetallic gamma prime (γ') or κ-carbide phase comprising a Group VIII metal, aluminum, and a stabilizer, wherein a lattice of at least a portion of the intermetallic gamma prime (γ') or κ-carbide phase exhibits an ordered configuration.

17. The earth-boring tool of claim 16, wherein the polycrystalline diamond material is substantially free of a catalyst material without leaching.

18. The earth-boring tool of claim 16, wherein the intermetallic gamma prime (γ') or κ-carbide phase is substantially evenly distributed throughout the polycrystalline diamond material of the polycrystalline diamond compact.

19. The earth-boring tool of claim 16, wherein the plurality of grains of diamond of the polycrystalline diamond material comprises nanodiamond grains.

20. The earth-boring tool of claim 13, wherein the intermetallic gamma prime (γ') or κ-carbide phase comprises $(Co,Ni)_3Al$.

* * * * *